US010143981B2

(12) United States Patent
Swamidass

(10) Patent No.: US 10,143,981 B2
(45) Date of Patent: Dec. 4, 2018

(54) SUPERIOR PAINT AND FLUID STIRRING AND BLENDING DEVICE TO PUSH UP HEAVIER PAINT OR FLUID FROM THE CONTAINER'S BOTTOM TO THE TOP

(71) Applicant: Paul Swamidass, Auburn, AL (US)

(72) Inventor: Paul Swamidass, Auburn, AL (US)

( * ) Notice: Subject to any disclaimer, the term of this patent is extended or adjusted under 35 U.S.C. 154(b) by 0 days.

(21) Appl. No.: 15/765,999

(22) PCT Filed: Mar. 16, 2016

(86) PCT No.: PCT/US2016/022546
§ 371 (c)(1),
(2) Date: Apr. 5, 2018

(87) PCT Pub. No.: WO2017/062058
PCT Pub. Date: Apr. 13, 2017

(65) Prior Publication Data

US 2018/0280903 A1 Oct. 4, 2018

(51) Int. Cl.

| | |
|---|---|
| ***B01F 11/00*** | (2006.01) |
| ***B44D 3/08*** | (2006.01) |
| ***B01F 7/00*** | (2006.01) |
| ***B01F 13/00*** | (2006.01) |
| ***B01F 15/00*** | (2006.01) |

(52) U.S. Cl.
CPC ..... *B01F 11/0082* (2013.01); *B01F 7/001* (2013.01); *B01F 7/004* (2013.01); *B01F 7/00033* (2013.01); *B01F 7/00341* (2013.01); *B01F 7/00416* (2013.01); *B01F 7/00583* (2013.01); *B01F 13/0028* (2013.01); *B01F 15/00506* (2013.01); *B44D 3/08* (2013.01)

(58) Field of Classification Search
CPC ..... B01F 11/0082; B44D 3/08
See application file for complete search history.

(56) References Cited

U.S. PATENT DOCUMENTS

| | | | | |
|---|---|---|---|---|
| 2,392,731 A * | 1/1946 | Fox | B01F 7/0025 | 366/327.1 |
| 2,659,581 A * | 11/1953 | Gray | B01F 7/00641 | 366/129 |
| 2,749,098 A * | 6/1956 | Johnson | A47J 43/105 | 366/243 |
| 5,890,875 A * | 4/1999 | Silvano | A63H 33/40 | 228/144 |

* cited by examiner

*Primary Examiner* — Anshu Bhatia

(57) ABSTRACT

The purpose of stirring a can of paint or fluids before their use is to lift to the surface heavier paint matter that fall out of the solution and tend to settle to the bottom of the container. Manual paint mixing, blending and stirring paddles are flat and not mechanically designed to lift or push to the top of the container all the heavier paint/fluid matter settled to the bottom of the container. This invention is a device designed to lift or push up the heavier paint/fluid matter from the bottom to the surface while using a stirring or to-and-fro reciprocal motion. This manual device could be motorized to turn it at appropriate speeds. One embodiment can be attached or clipped to the foot of the common flat paint-stirring or blending paddle to transform it into a more effective paint mixing and blending tool.

5 Claims, 11 Drawing Sheets

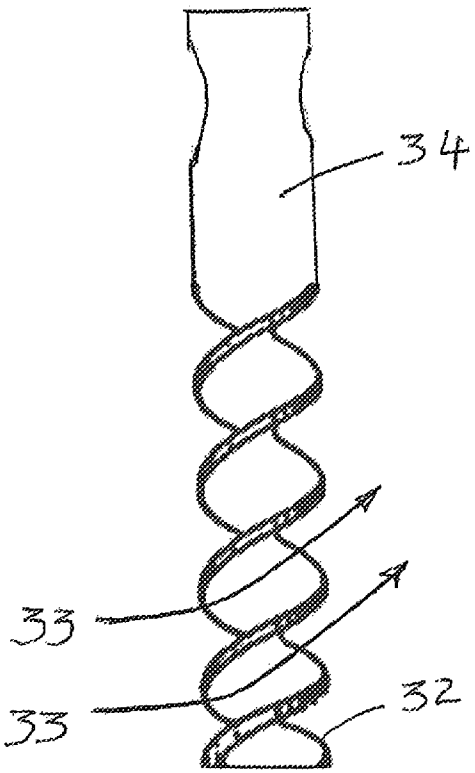
FIGURE 3
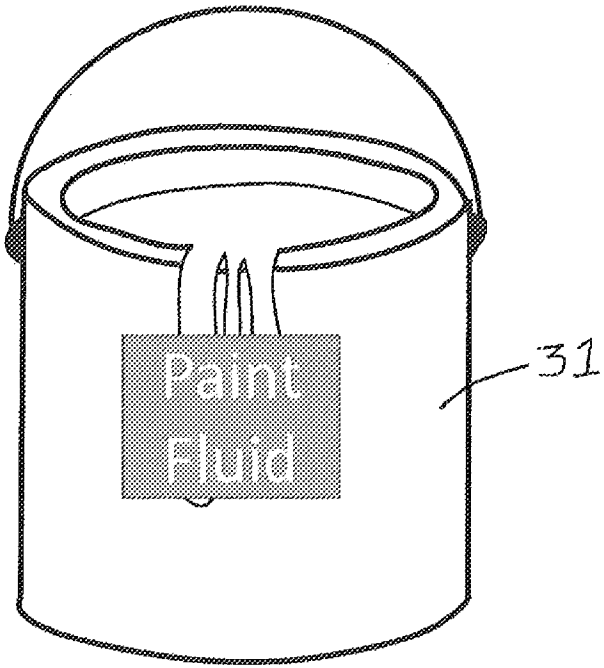

Side View

Front view

Top View

SUPERIOR PAINT AND FLUID STIRRING AND BLENDING DEVICE TO PUSH UP HEAVIER PAINT OR FLUID FROM THE CONTAINER'S BOTTOM TO THE TOP

CROSS-REFERENCE TO RELATED APPLICATIONS

This revised application Ser. No. 15/765,999 is national stage version of a 371 of PCT/US2016/022546 dated Mar. 16, 2016

STATEMENT REGARDING FEDERALLY SPONSORED RESEARCH OR DEVELOPMENT

"Not applicable."

THE NAMES OF PARTIES TO A JOINT RESEARCH AGREEMENT

"Not applicable."

INCORPORATION-BY-REFERENCE OF MATERIAL SUBMITTED ON A COMPACT DISC OR AS A TEXT FILE VIA OFFICE ELECTRONIC FILING SYSTEM (EFS-WEB)

"Not applicable."

STATEMENT REGARDING PRIOR DISCLOSURE BY THE INVENTOR OR A JOINT INVENTOR

"Not applicable."

BACKGROUND OF INVENTION

This application calls reference to U.S. patent application Ser. No. 14/880,216 dated Oct. 10, 2015 and PCT application PCT/US2016/022546 and associated International Search Report with priority date, Oct. 10, 2015. International Search Report approved all eight claims on Novelty (N), Inventive Step (IS), and Industrial Applicability (IA).

(1) the Field of the Invention

This invention pertains to mixing or stirring paints, stains and fluids that have allowed heavier substance to settle to the bottom of the container over time. Paint pigments tend to fall out of colloidal suspension and settle at the bottom of the container, and the purpose of stirring the paint prior to use is to replace the pigments back into the colloidal suspension.

When paints and fluids in containers are stored, heavier matter in them tend to settle to the bottom of containers. Before using the paints/stains/fluids for their intended purposes, it becomes imperative that the paint and fluids in the container are stirred to mix the heavier bottom-settled paint/fluid matter with rest of the fluid in the container to a uniform consistency.

(2) Description of Related Art

For the purpose of manual stirring of paint before use, stirring paddle is the most widely used device; examples being U.S. Pat. No. 1,732,714, U.S. Pat. No. 4,884,895 and an improved version of the paint stirrer paddle in U.S. Pat. No. 4,197,017. These paddies fall short of the intended purpose—they do not help lift or push up any and all settled paint/fluid from the bottom of the container to the top; as the paddles are moved with a stirring motion, paint moves sideways not upwards.

Current paint stirrers are inadequate. There is a need for a simple and elegant paint stirrer that would push up or lift heavier settled matter from the bottom to the top, and fluid from the top to the bottom.

BRIEF SUMMARY OF THE INVENTION

This invention is a mechanical stirring device that is designed with the purpose of stirring fluids and paints such that bottom-settled heavier matter can be moved up for uniform mixing with the paint/stain/fluid in the container prior to the use of the paint/stain/fluid.

DETAILED DESCRIPTION OF DRAWINGS AND INVENTIONS

Paints in general, and pigmented paints including metallic paints, acrylic lacquers and stains need proper mechanical stirring to replace and redistribute colloidal particles or pigments that tend to settle to the bottom of the container. The greatest challenge to paddles used for the purpose is the need to lift up settled matter from the bottom of the container to the top to enable blending the bottom-settled matter uniformly in the container.

The present invention is a stirring device designed for a novel and elegant way of moving heavier paint or liquid from the bottom of the paint/fluid container to the top, and to bring down the lighter fluid from the top of the container to the bottom to mix the paint or fluid uniformly.

This invention uses paint stirring paddles that are purposely shaped to push upwards bottom-settled matter in containers using a stirring or a back and forth reciprocal motion.

While several embodiments are possible, three embodiments are described below.

Embodiment 1

Because of the shortcomings of flat paddles in use today, this invention uses a paddle device shaped in the form of a twisted-screw or screw-conveyor so that, as the device is used to stir the paint in the container manually or otherwise, heavier paint matter at the bottom of the can is move up the screw-like paddle to enable mixing uniformly and quickly of the paint in the entire container.

Figure 1:
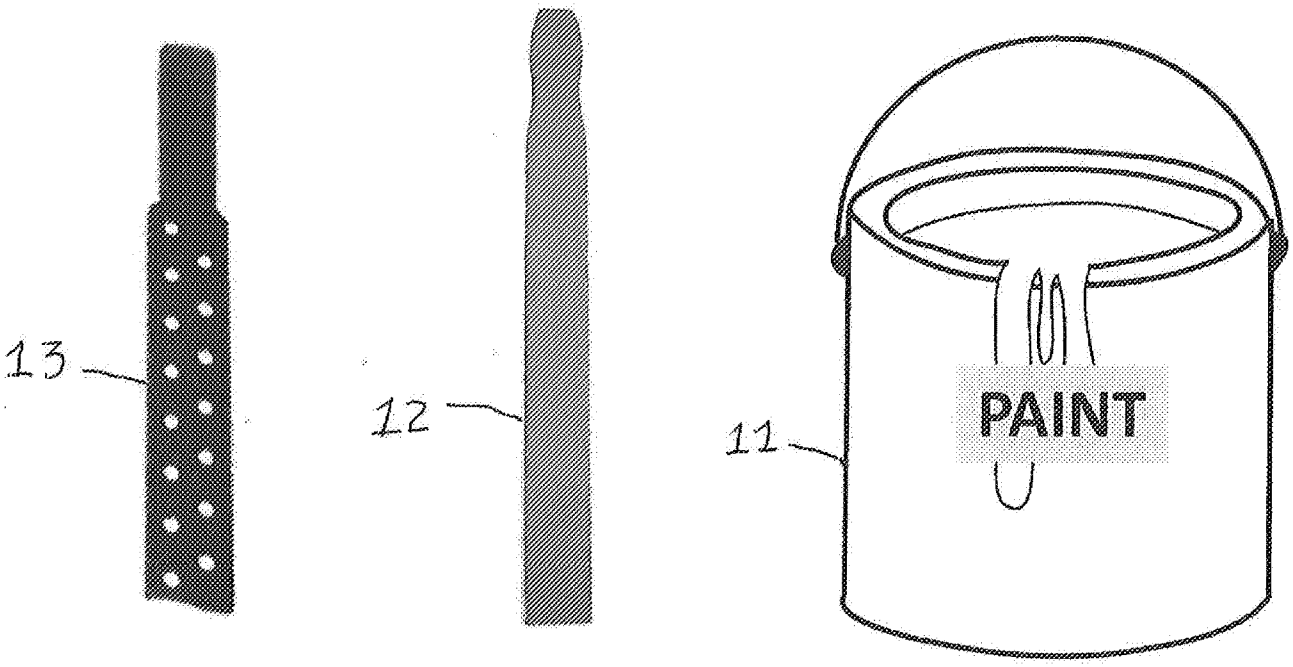
PRIOR ART FIGURE 1
FIG. 1: shows dominant devices used as paint stirrers today.
Figure 2:
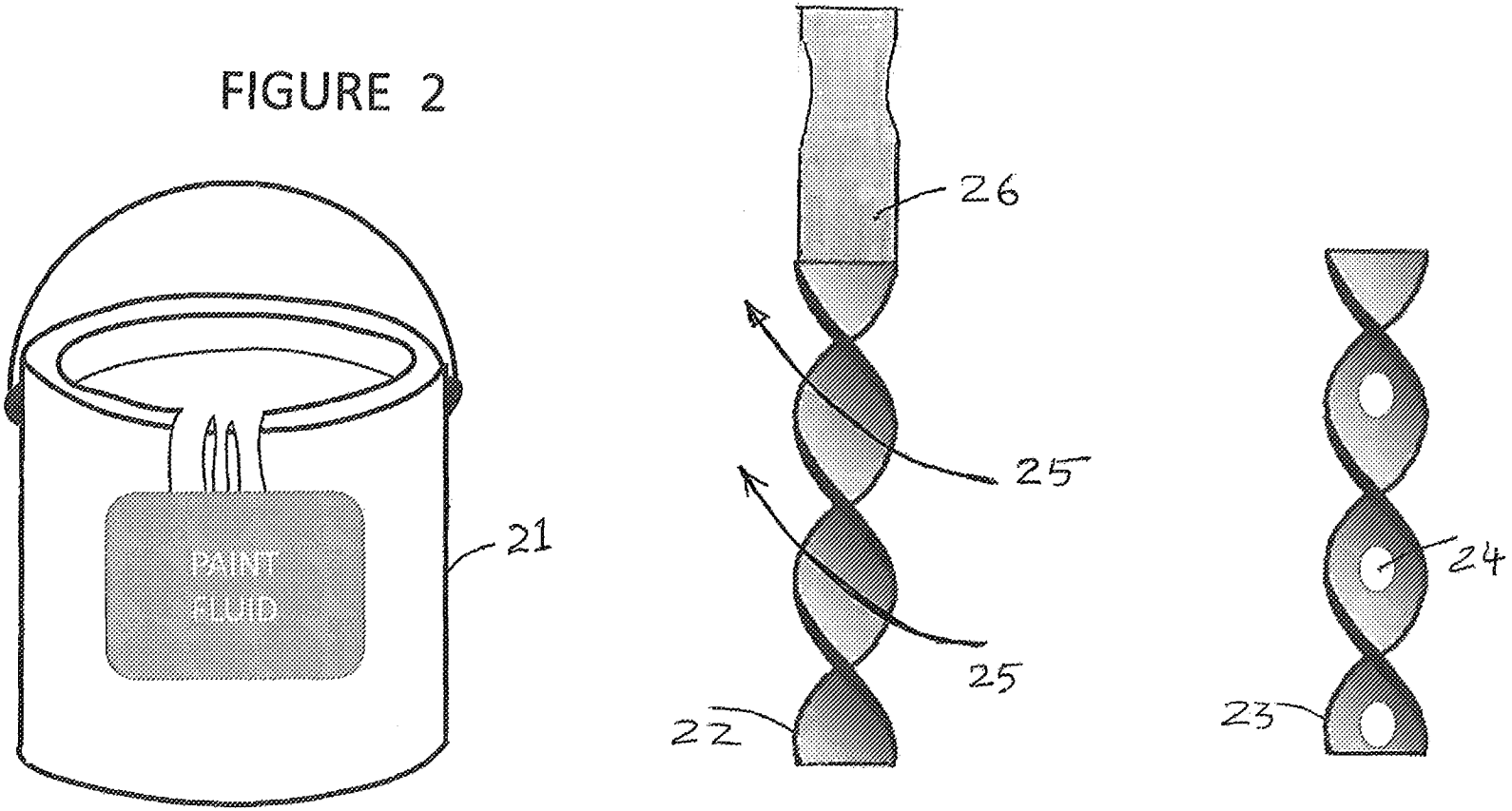
FIG. 2: shows a twisted metal strip device serving as a paint/liquid stirring paddle.
Figure 4:
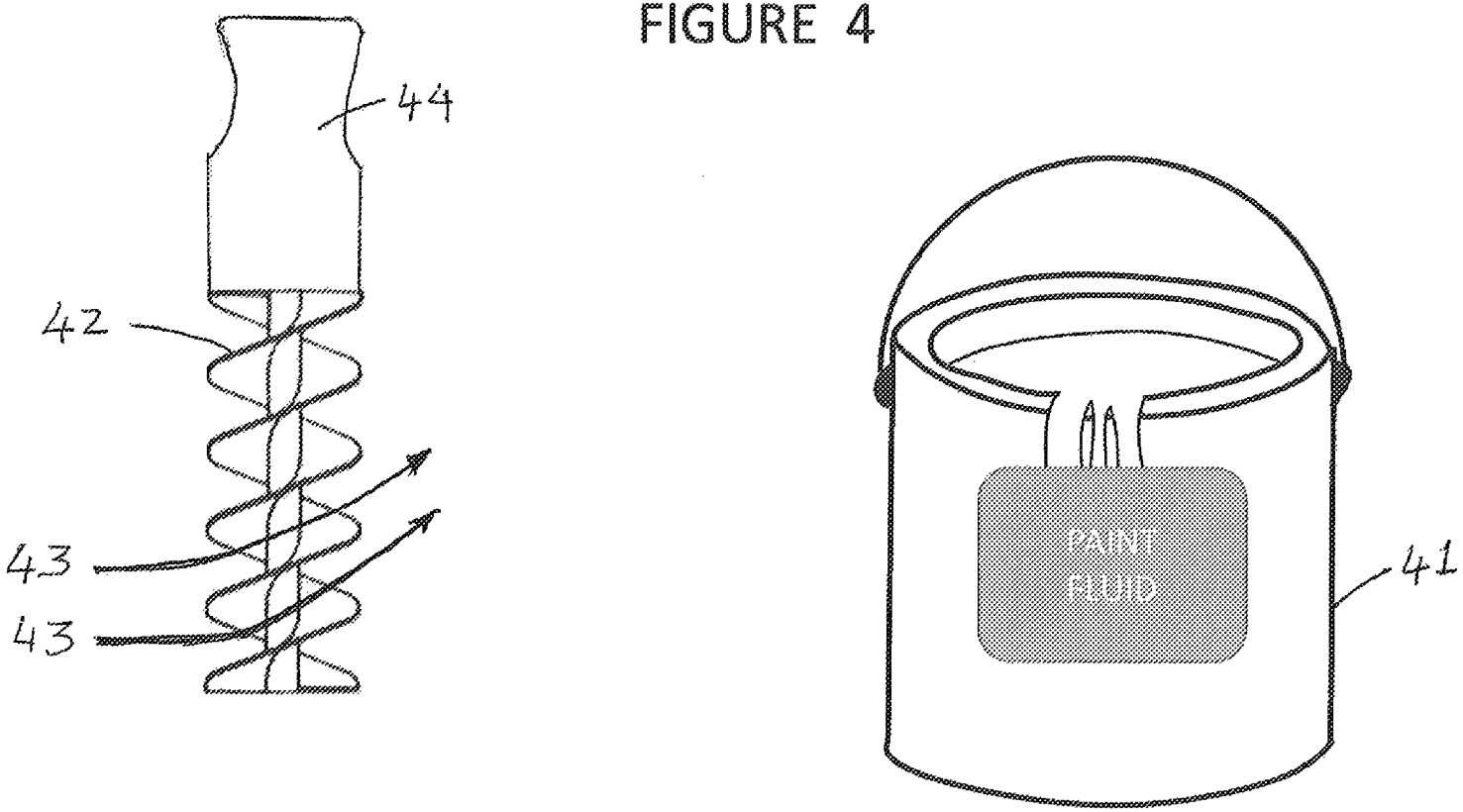

In FIG. 1, 11 is the paint container and 11 and 12 are commonly used paint stirrers that push paint sideways but have no capability to lift or move the paint upwards. FIG. 2 shows one embodiment of the invention, where a twisted metal strip or molded polymer 22 is used as the paddle to stir paint/fluid in a can/container 21. Another version of the invention shows the stirring device 23 with holes 24. Arrows 25 show the movement of paint from the bottom of the can to the top can as the device is used to stir the paint in the container. The paddle has a grip 26.

Embodiment 2

Figure 5:
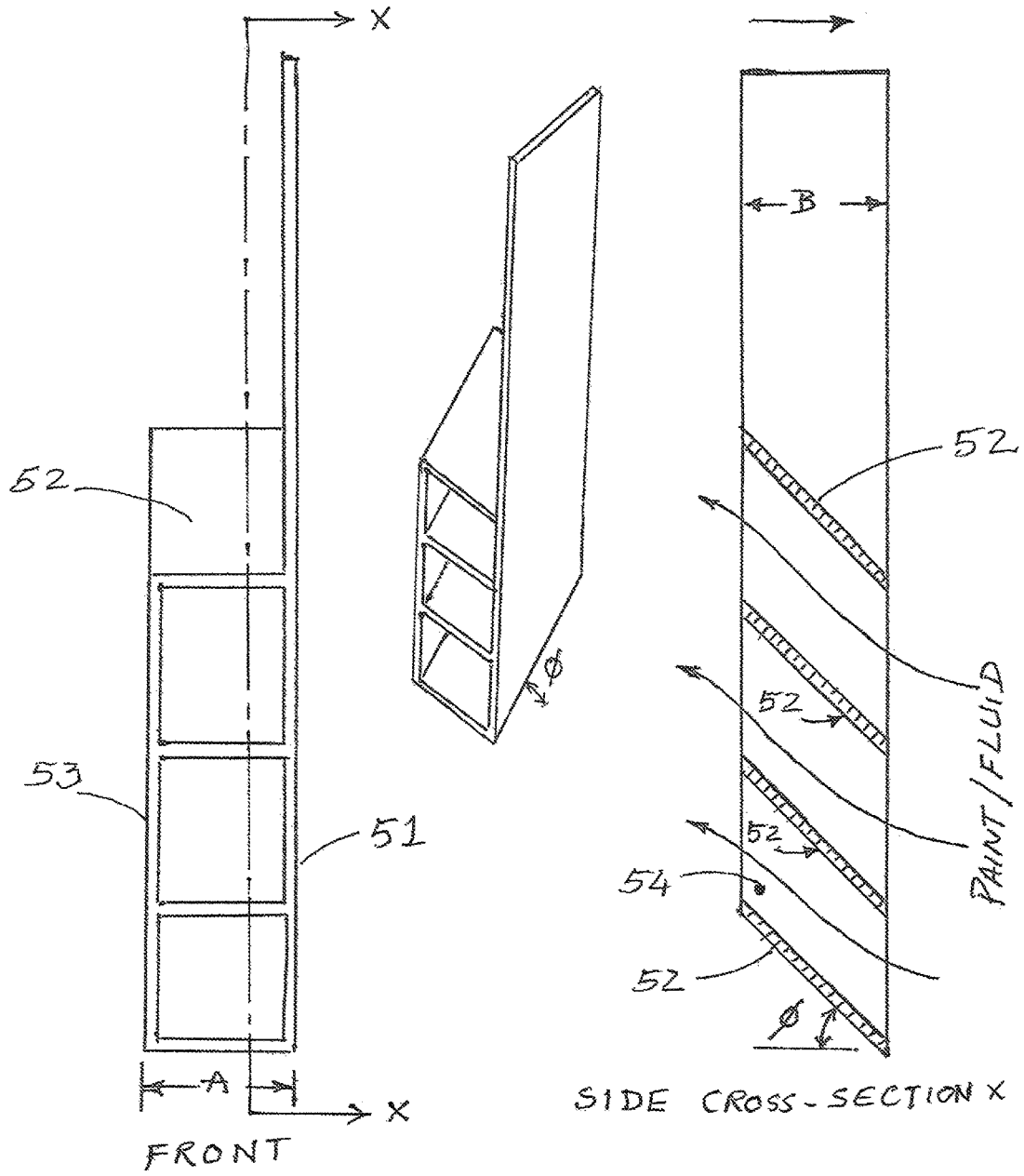
FIG. 5 shows the paddle with built in three channels that push or lift paint from the bottom of container when the paddle is used to stir paint/fluids with a back and forth reciprocal motion.

In FIG. 5, the vertical paddle 51 of width B, has three built-in channels of width A formed by four horizontal members 52, and 53, a vertical member. The channels are inclined upwards at an angle Phi so that, when the paddle is moved left to right, the cross-section X of the paddle shows heavier, bottom-settled matter of the paint/fluid is pushed upwards as depicted by the arrows.

Figure 6:
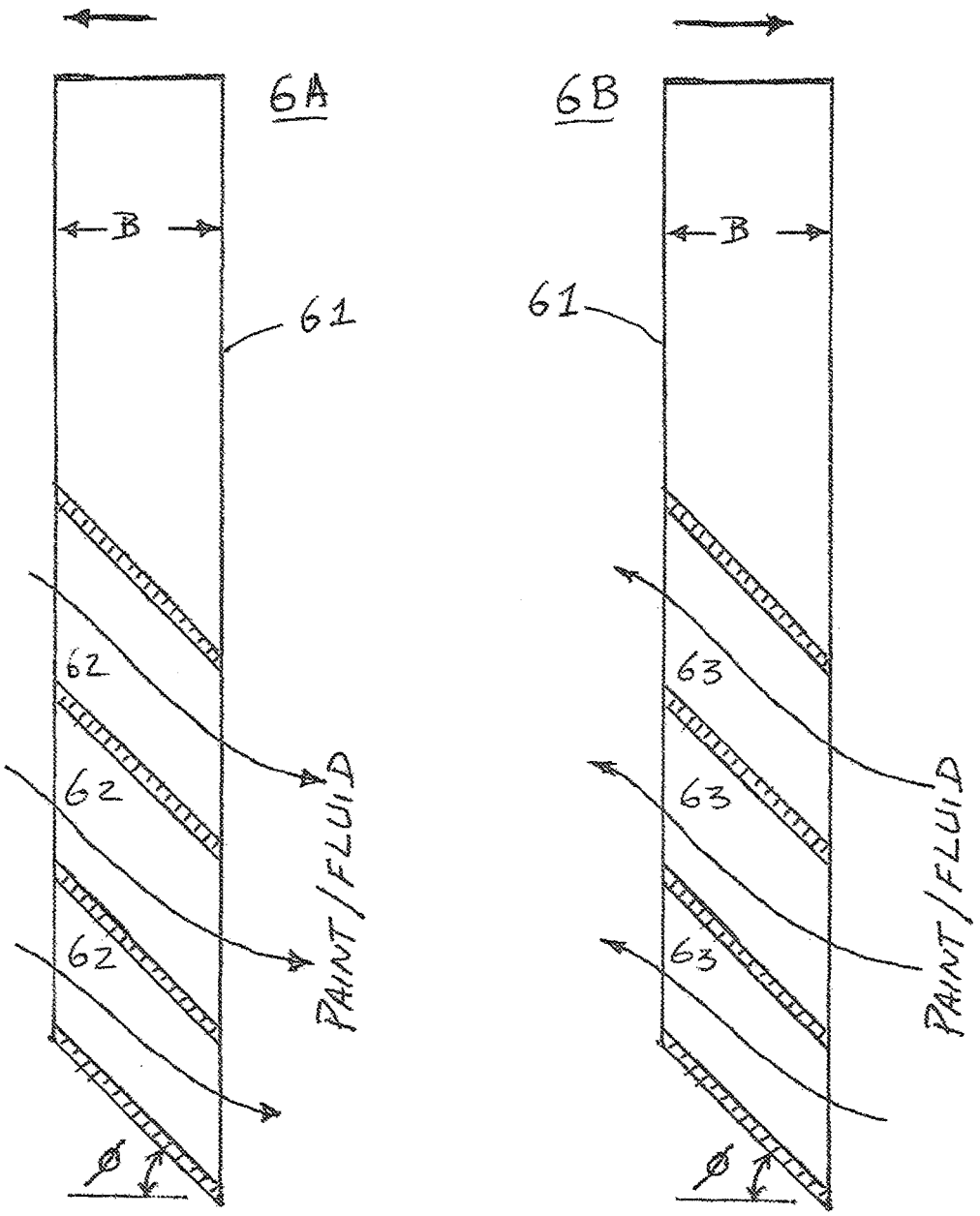
FIG. 6 shows the flow of paint/fluid either upward or downward when the paddle is pushed reciprocally back and forth in a paint/fluid container.

In FIG. 6, the arrow above paddle 61 shows that the paddle is moved right to left in FIG. 6A causing the fluid to be pushed downwards through three channels 62 inclined downwards. The arrow above paddle 61 in FIG. 6B shows paddle 61 is being moved left to right causing the bottom-settled paint/fluid to be pushed upwards through the three channels 63 in the figure. Thus, the to-and-fro reciprocal motion of paddle 61 moves the paint upward in one direction, moves the paint downwards on the return stroke of the paddle.

Figure 7:
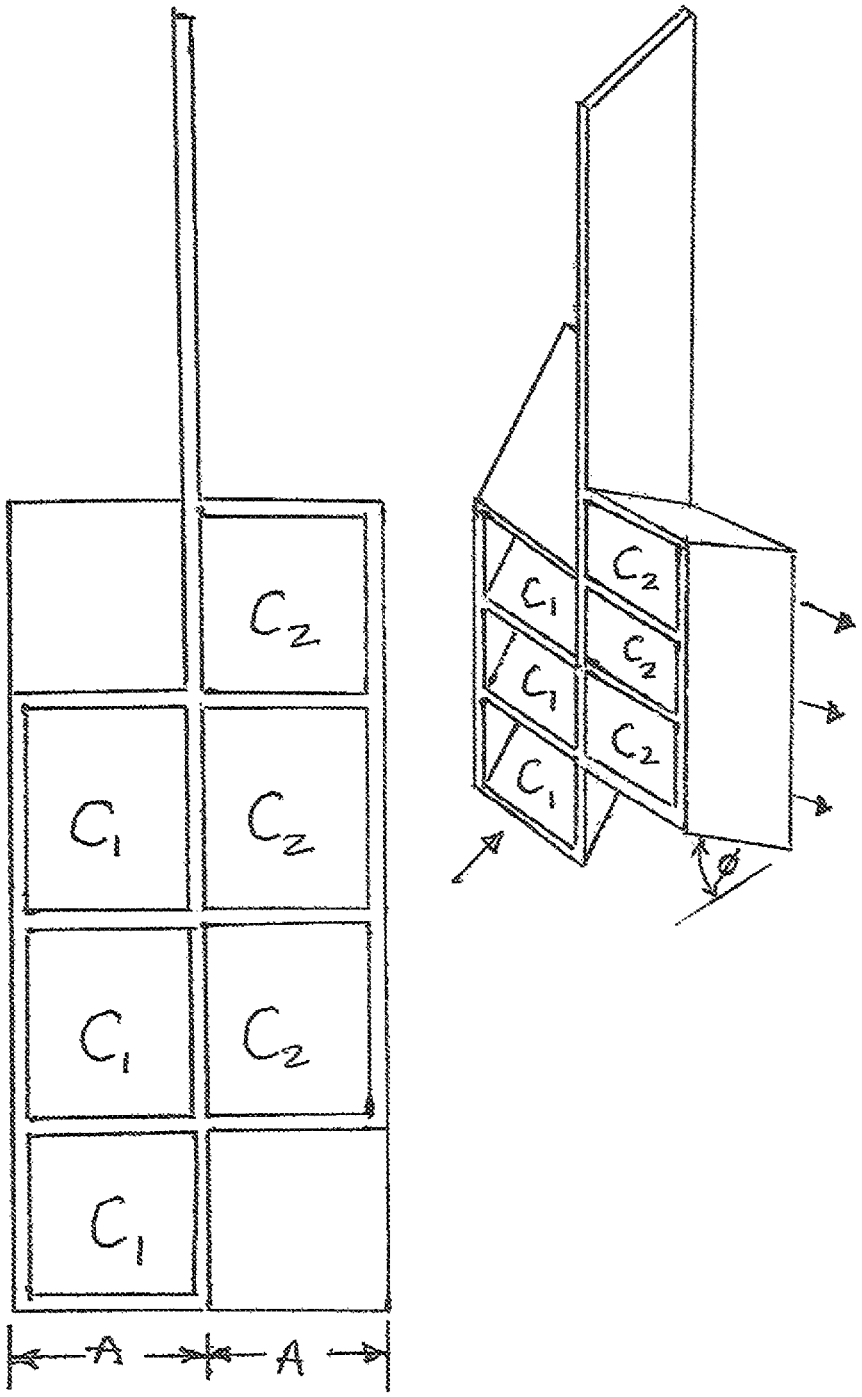
FIG. 7 shows the device in FIG. 5 with two sets of channels with opposite effect when moved back and forth reciprocally; one set of channels pushing the bottom-settled matter upwards, while another set of channels pushing the lighter fluid from the top to the bottom for uniform mixing of bottom-settled heavier matter with the rest of the paint/stain/fluid.

FIG. 7 shows the integration of two paddles into one with each side of the paddle pushing the paint or fluid in opposite direction to each other; channels C1 push paint or fluid upwards while channels C2 push paint/fluid downwards during a single stroke of the paddle for quicker and better mixing of the paint/fluid being stirred with paddle 71. Paddle 71 may be moved reciprocally to-and-fro inside the container, and could be used as a conventional paddle stirrer too.

Embodiment 3

Figure 8:
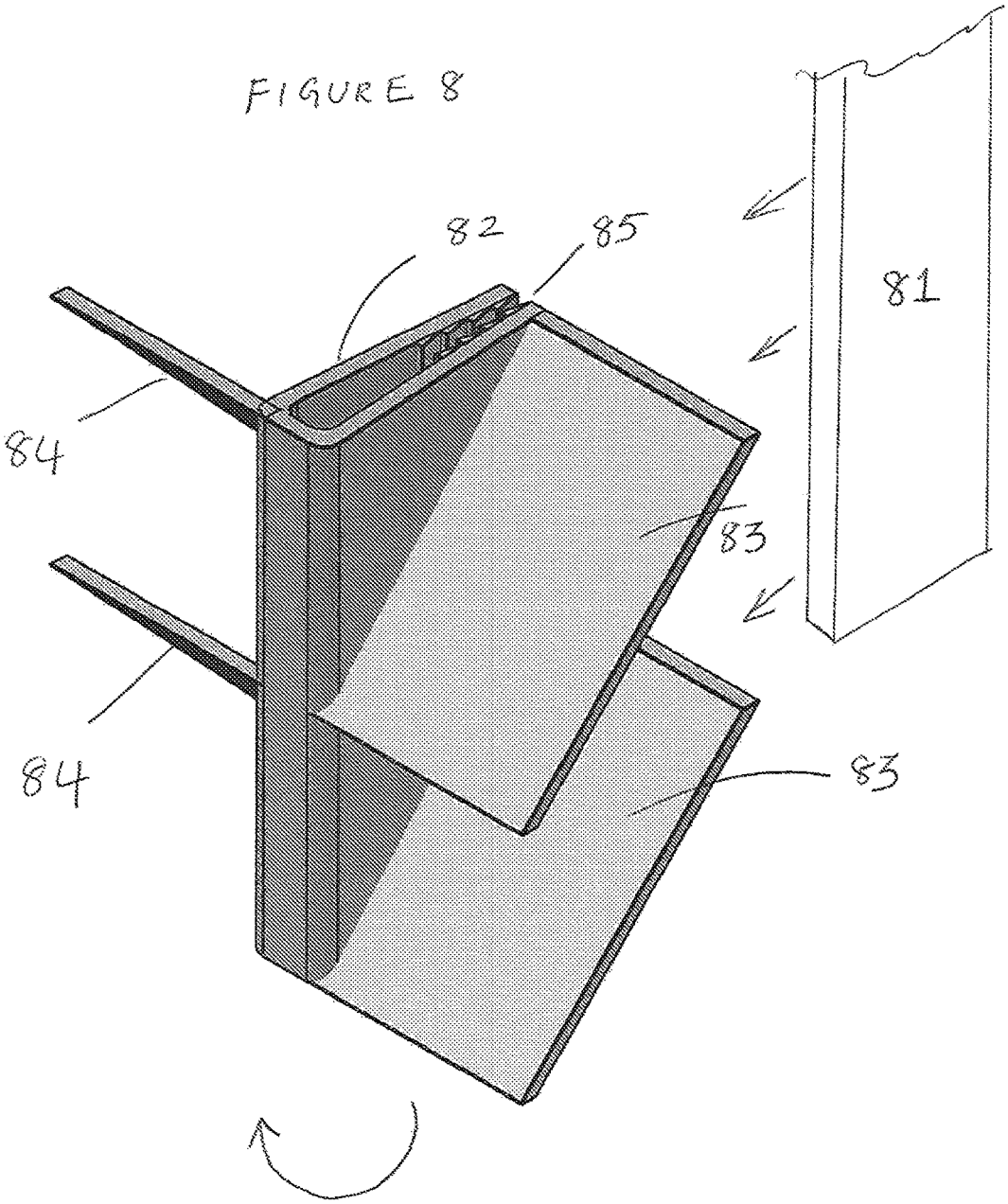
FIG. 8 shows an isometric view of a "turbine foot," which is a tight-fitting attachment to the foot of the common paint paddle made of wood or similar material to enable the common paddle to push the paint upwards during the typical circular motion of the paddle, while "mixing" the paint.

In FIG. 8, 81 is the typical flat wooden paddle used for "mixing" paint today. Item 82 is the "turbine foot" (TF) invention that can be tightly attached to the foot of the paddle by pushing the paddle hard into the slot 85 in the TF. Four blades 83 and 84 are shown on the opposite sides of the TF are inclined at 90 degrees to each other along their length (other inclinations are not shown in this embodiment). During the clockwise rotary motion of the paddle, blades 83 and 84 will move the paint upwards for the configuration shown in FIG. 8.

Figure 9:
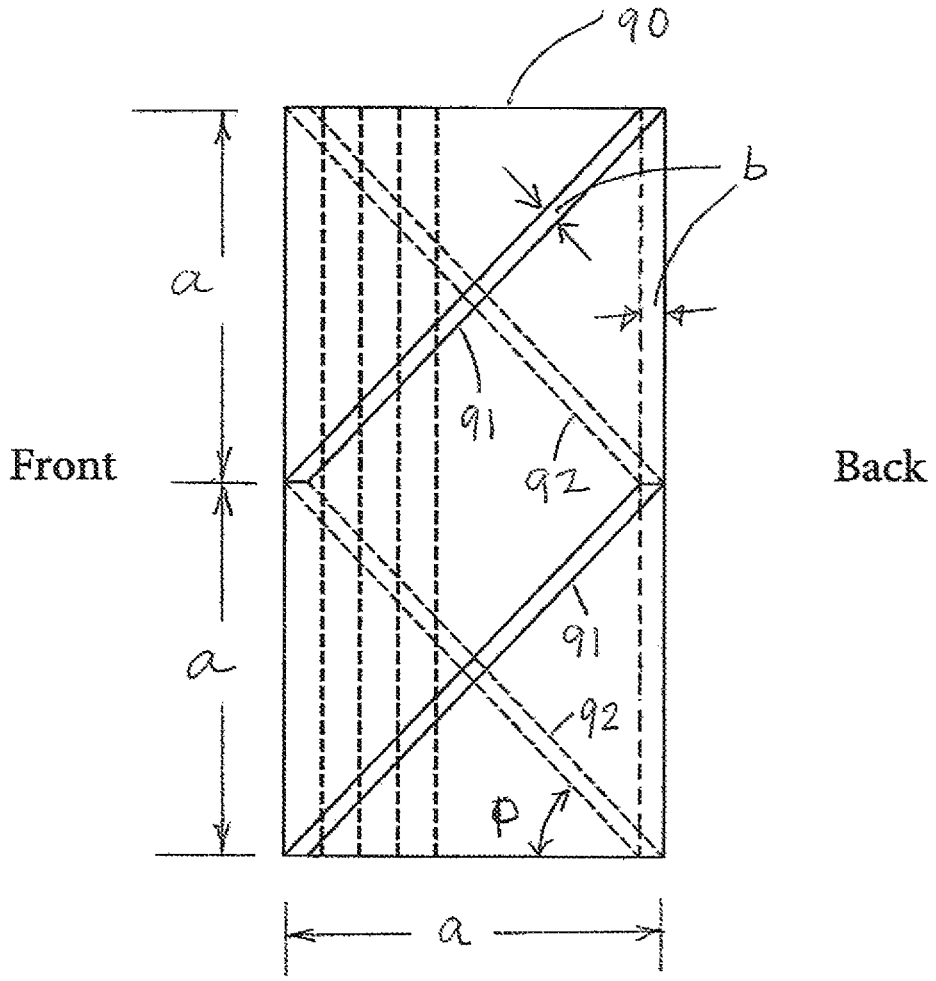
FIG. 9 shows the side view of the "turbine foot."

In FIG. 9, item 90 is the TF, where 91 and 92 are four blades. Dimension "a" of the TF could be varied; "a" could be made equal to the width of the paddle, as one option. The dimension "b" is the thickness of the blades and the entire structure including the flanges making up the slot for holding the paddle in FIG. 8. All the blades are inclined at 45 degrees for the given configuration.

Figure 10:
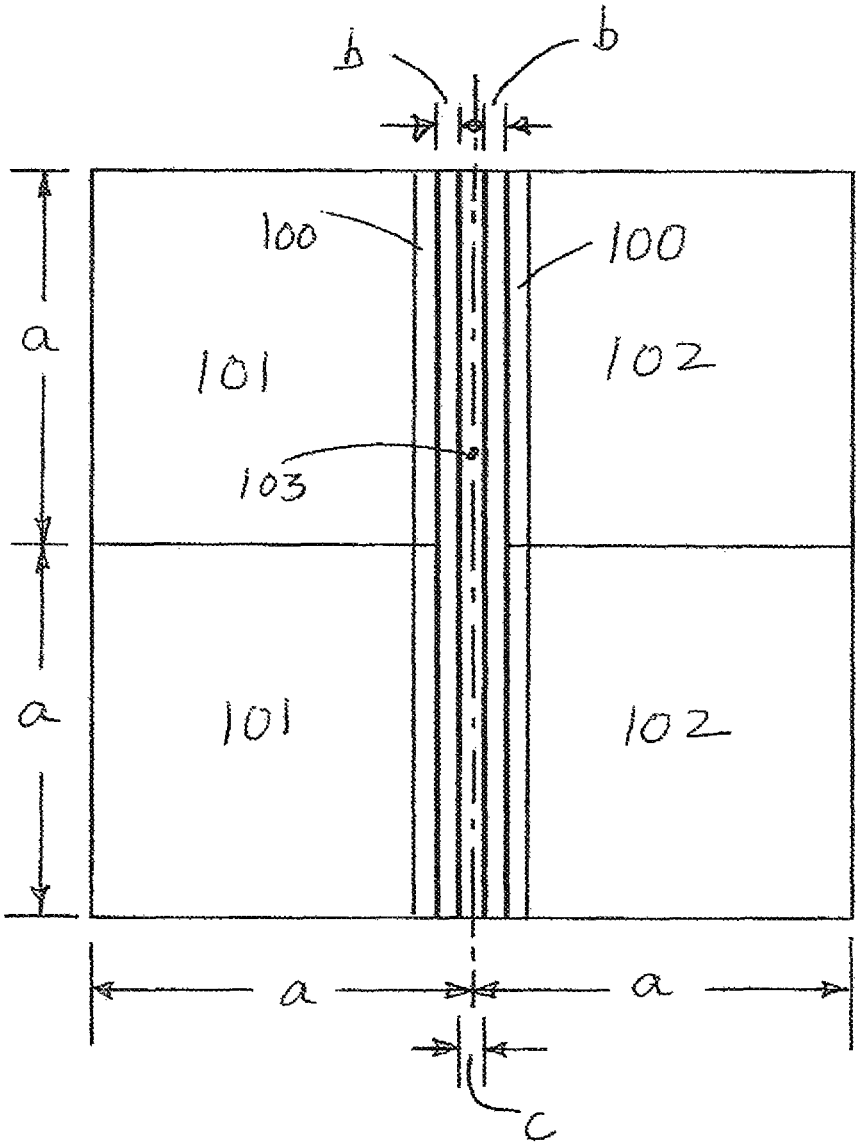
FIG. 10 shows the front view of the "turbine foot."

In the front view shown in FIG. 10, 100 are the two flanges of TF where 101 and 102 are the inclined blades attached to the flanges 100. The paddle is pushed into the slot 103 for a tight fit while stirring the paint or any fluid. The dimension "b" is the thickness of the flanges and the entire structure. The width of the slot between the two flanges on the open end is "c," which is less than the thickness of the paddle to enable the paddle to be gripped tightly between the two flanges.

Figure 11:
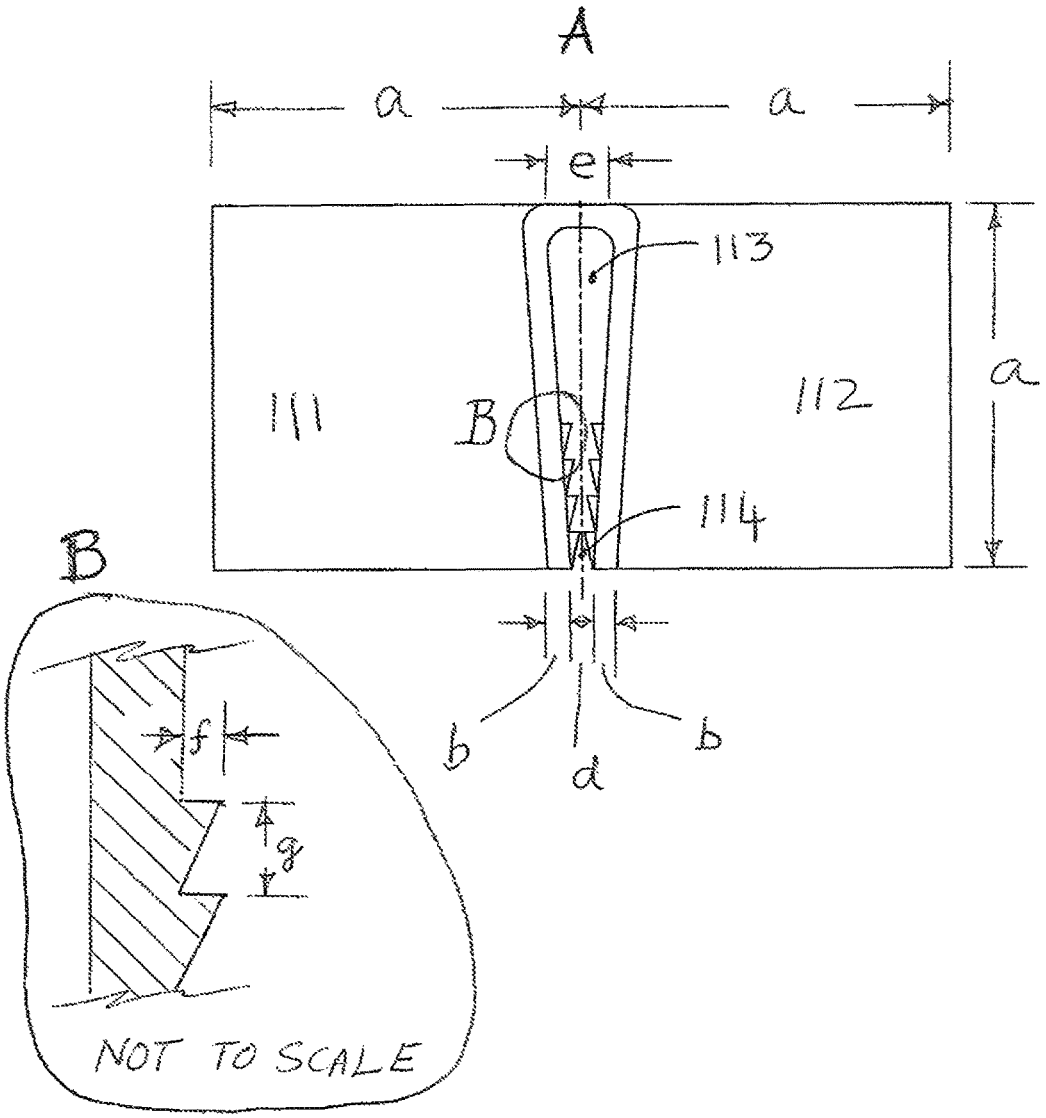
FIG. 11 shows the top view of the "turbine foot."

Top view in FIG. 11 has three parts, 11A, and 11B. In FIG. 11A, 111 and 112 are the tilted blades, 113 is the slot between the flanges that takes the paddle, and "e" is the width of the slot at the fixed end of the flanges, where the slot is at least equal to the thickness of the paddle or slightly greater. 114 shows the narrow end of the slot before the paddle is inserted, allowing the flanges to exert pressure on the paddle once it is forced into the slot. FIG. 11B shows the inside of the flanges that are serrated from top to the bottom to give a more positive grip on the paddle, while the paint or fluid is stirred. Serrated flanges is an option to enhance the grip on the traditional paddle; flanges may be designed to provide strong enough grip on the paddle without the need for serrations inside the flanges.

It is noted that these are only three of the several other possible embodiments of this invention to lift the heavier settled substance from a container's bottom, while stirring pains or fluids for superior mixing.

What is claimed is:

1. A superior paint/fluid stirring device, comprising;

a. an elongated flat portion handle with an upper end and a lower end;

b. wherein the upper end is shaped to serve as a firm one-handed grip;

c. two sets of a plurality of angled channels positioned on opposite sides of the elongated flat handle, wherein a first set of angled channels on one side of the handle are inclined relative to a horizontal axis, and wherein a second set of angled channels positioned on the opposing side of the elongated flat handle from the first set of angled channels are declined relative to the horizontal axis wherein each channel is formed by horizontal members and vertical members so they are built into the elongated flat handle.

2. The superior paint stirring device in claim 1 where the inclined channels to push and guide the settled heavier matter upwards may take a linear or curved shape.

3. The devices in claim 1 may be motorized or automated to be used at appropriate speeds for reciprocal or circular motion in larger containers of paints or fluids.

4. A paint stirring device that can be attached or clipped to foot of common paint or fluid stirring paddle or stick, comprising:

a. a clip which firmly grips the stirring paddle or stick by a first flange and a second flange, the clip comprising a plurality of serrations running from the top to the bottom of each flange, b. a first set of blades attached to the first flange having an angle relative to a horizontal axis configured to move paint upwards and a second set of blades in an opposing angle to the horizontal axis from the first set of blades configured to move paint in a downwards direction.

5. The device of claim 4 wherein the device is made of metal, wood or polymers/plastics of appropriate thickness and properties to stir heavy paint, and to grip the paddle or stick without falling off during a vigorous stirring or blending action.

* * * * *